United States Patent [19]

Libit

[11] 4,077,537

[45] Mar. 7, 1978

[54] ONE PIECE DISPENSING CLOSURE

[76] Inventor: Sidney M. Libit, 441 Lakeside Ter., Glencoe, Ill. 60022

[21] Appl. No.: 688,989

[22] Filed: May 24, 1976

[51] Int. Cl.[2] ..... B65D 41/50

[52] U.S. Cl. ..... 215/253; 215/257

[58] Field of Search ..... 215/247, 250, 253, 257, 215/306; 220/277, 278; 222/81, 83, 543, 558; 30/6.1, 16

[56] References Cited

U.S. PATENT DOCUMENTS

| | | | |
|---|---|---|---|
| 2,149,795 | 3/1939 | Skoblin | 222/558 X |
| 2,977,973 | 4/1961 | Chakine | 215/306 X |
| 3,182,858 | 5/1965 | Beaudoin | 222/83 |

FOREIGN PATENT DOCUMENTS

| | | | |
|---|---|---|---|
| 1,232,373 | 4/1960 | France | 215/250 |

*Primary Examiner*—Donald F. Norton
*Attorney, Agent, or Firm*—Leonard S. Knox

[57] ABSTRACT

A tamper-proof, one-piece device for securement to a receptacle for a fluent substance, the device including a membrane to seal the contents of the receptacle prior to initial use but which is rupturable through the medium of a piercing point to enable pouring of the contents. The membrane-puncturing element serves as a stopper to inhibit leakage and evaporation during periods of non-use.

5 Claims, 30 Drawing Figures

FIG. 4
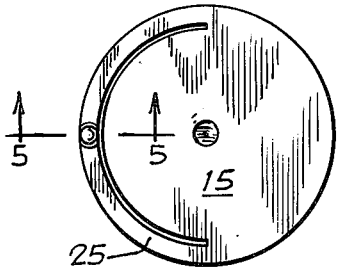
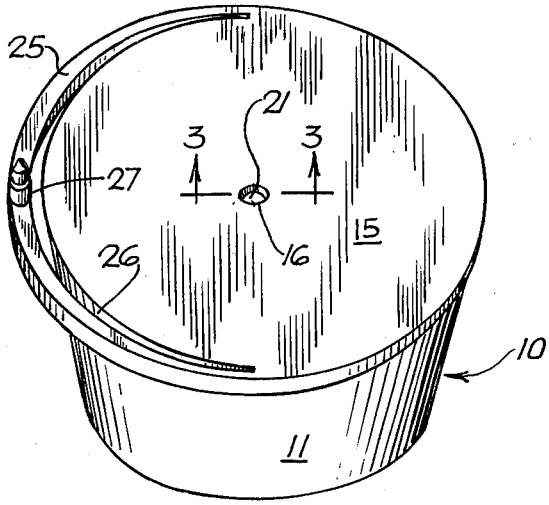
FIG. 1
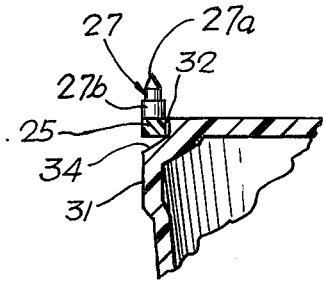
FIG. 5
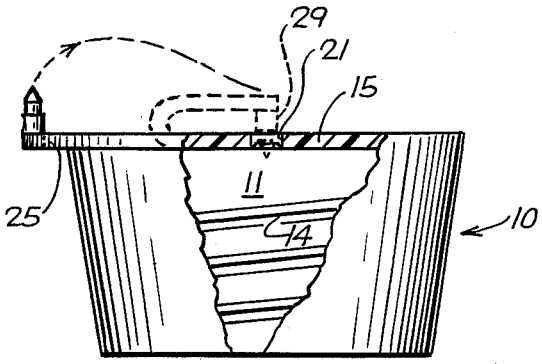
FIG. 2
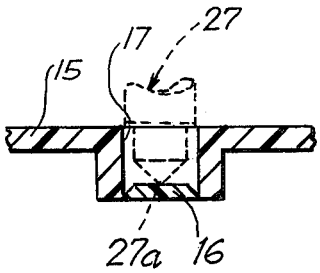
FIG. 3

FIG. 6
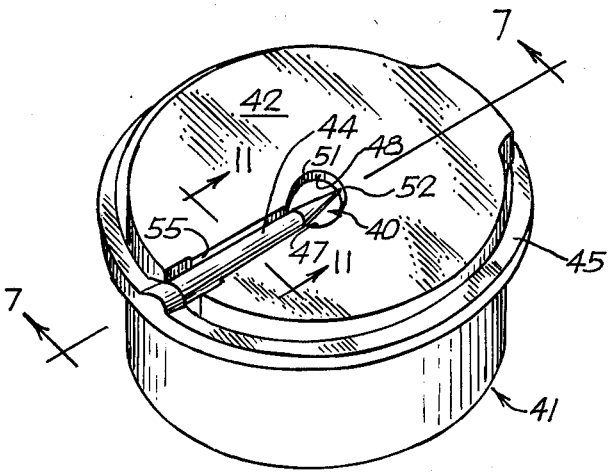
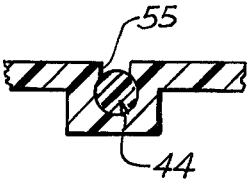
FIG. 11
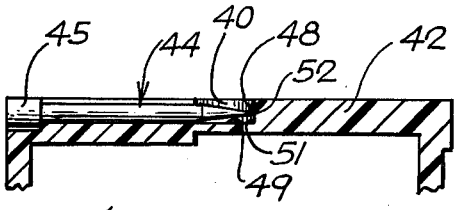
FIG. 7
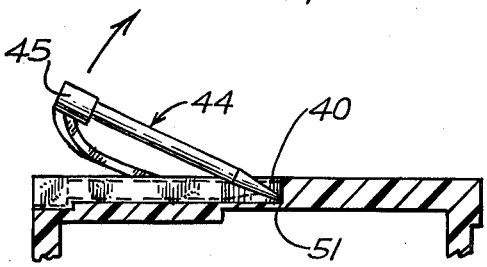
FIG. 8
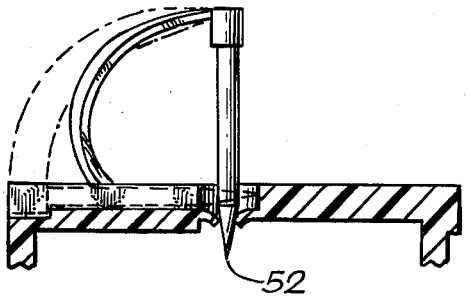
FIG. 9
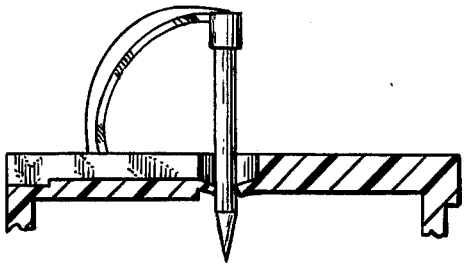
FIG. 10

FIG. 12
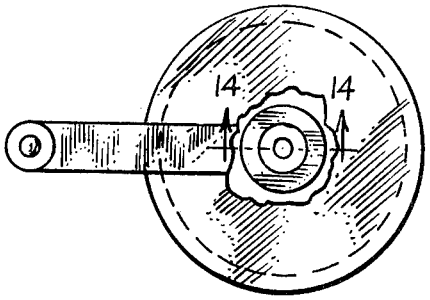
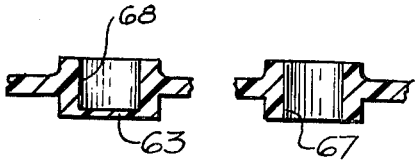
FIG. 14a FIG. 14b
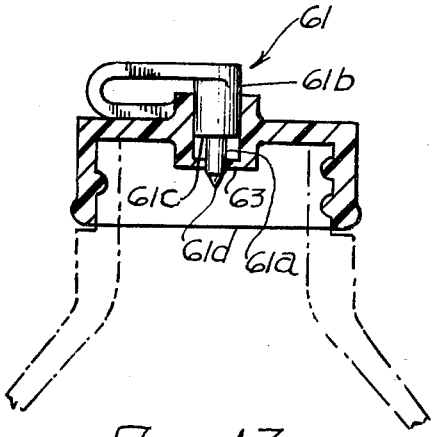
FIG. 13
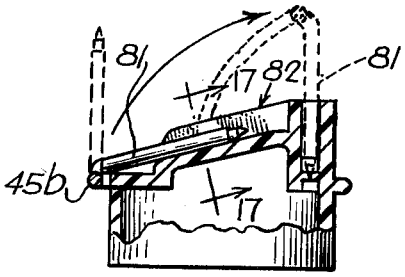
FIG. 16
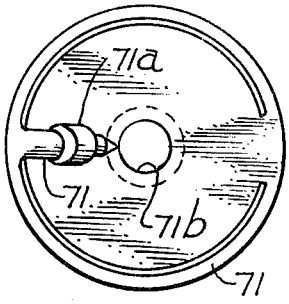
FIG. 15
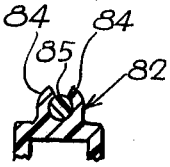
FIG. 17

FIG. 18
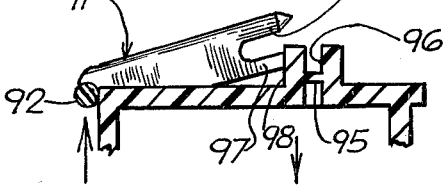
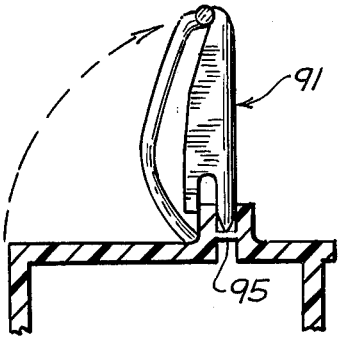
FIG. 19
FIG. 20
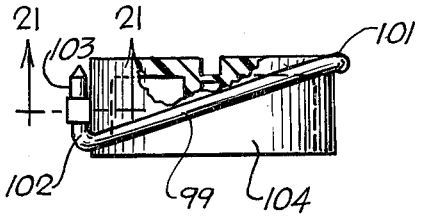
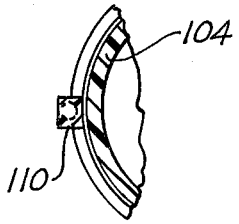
FIG. 21
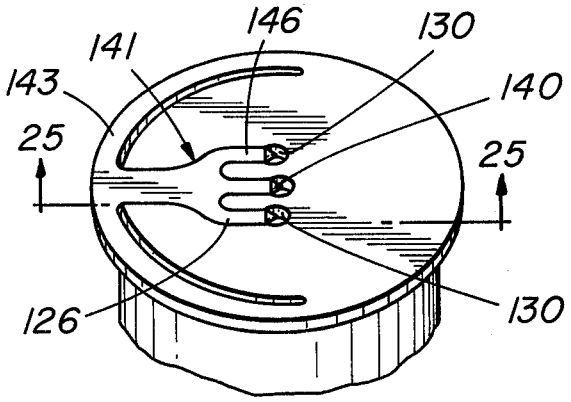
FIG. 24
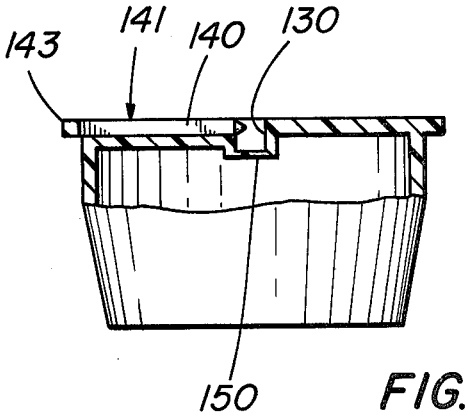
FIG. 25
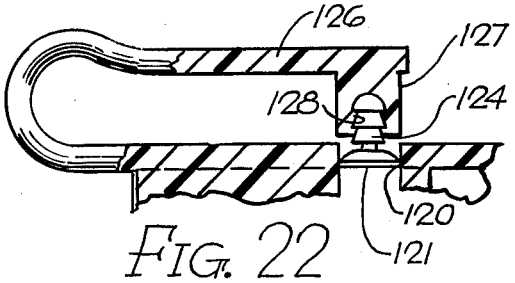
FIG. 22
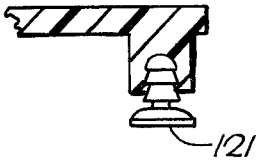
FIG. 23
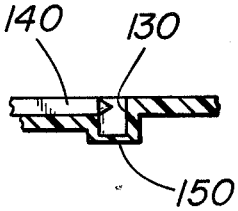
FIG. 26a
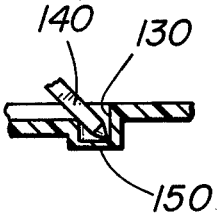
FIG. 26b
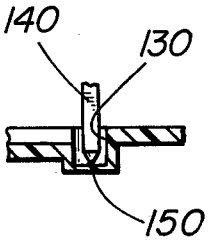
FIG. 26c
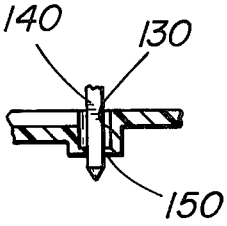
FIG. 26d

ONE PIECE DISPENSING CLOSURE

BACKGROUND OF THE INVENTION

Closures of plastics materials for receptacles for fluent substances have been known wherein a membrane closes the pouring opening but which is adapted to be punctured at the time access to the contents is desired. However, those known to me are unnecessarily complicated, unreliable, and include features mitigating against economical molding. Moreover, parts of the device have been formed so as to protrude beyond the generally circular outline such devices are given in order that the same may be assembled rapidly by automatic machinery, viz. by the use of a spinning chuck which grips the device and rotates the same into tight engagement with the neck of the receptacle by means of interengaging threads. For these and other reasons the packaging industry has not adopted them.

SUMMARY OF THE INVENTION

In one aspect the invention device comprises a generally cylindrical body or base preferably molded from a plastics composition characterized by good elastic memory, i.e., resiliency coupled with return to the as-molded condition upon removal of deforming forces. The body has means to attach the same to means defining the exit of the container, e.g. a threaded neck or a rib and groove combination for push-on assembly by force applied axially of the receptacle. Such attaching means are conventional and are not believed to required elaboration. Integrally molded with the body is a bail extending peripherally of the base and a combined punch and stopper is secured to one segment of the bail. The dimensions and resilience of the material are such that the bail may be readily deformed by the fingers to fulfill the functions hereinafter to be ascribed thereto. At the axis of the closure and in the top wall thereof — the device being of generally cylindrical form — there is a recess having a membrane as a floor. This membrane is so dimensioned as to be readily punctured for pouring of the contents. The punch carried by the bail is so positioned that the punch may be displaced from an idle position to a position whereat the punch may be thrust through the membrane. Preferably, the punch has a cylindrical guide portion engaged in a complementary bore surrounding the membrane in order to steady the punch during the membrane-piercing operation. In order to preserve a non-interfering position of the bail and punch when the same are out of use, detent means may be provided. The arrangement of the several parts of the closure is such that the piece part may be stripped from the mold by a direct pull, thus dispensing with the inordinate expense of movable cores which are incorporated in the mold only at considerable cost, and reduce the production rate.

Reverting to the recess and its cooperative punch, it is advantageous to form the lateral wall of the recess such that a corner is formed between the floor and the lateral wall; further that the point of the punch, in idle position, lies in said corner. Accordingly, initial lifting of the bail to actuate the punch is effective to swing the punch into a position normal to the membrane, whereafter continued swinging of the bail and steering of the punch, combined with force applied to the shank of the punch will thrust the apex of the punch through the membrane. Stated otherwise, no particular attention need be paid to guiding of the punch once it has been started into the recess.

BRIEF DESCRIPTION OF THE DRAWING

FIG. 1 is a perspective view of a closure in accordance with one aspect of the invention;

FIG. 2 is a combined side elevation and cross section of the closure of FIG. 1;

FIG. 3 is a partial cross section taken on the line 3—3 of FIG. 1;

FIG. 4 is a top plan view of a modified form of the closure of FIG. 1;

FIG. 5 is a partial cross section taken on the line 5—5 of FIG. 4;

FIG. 6 is a perspective view of another form of closure embodying the principles of the invention;

FIG. 7 is a partial cross section taken on the line 7—7 of FIG. 6, in the idle condition;

FIG. 8 is a cross section similar to that of FIG. 7 but with the bail and punch in a partially actuated condition;

FIG. 9 is a view similar to FIG. 8, but showing a further stage of actuation;

FIG. 10 is a view similar to FIG. 9 but in the final position, with the just-formed pouring opening sealed;

FIG. 11 is a partial cross section taken on the line 11—11, of FIG. 6;

FIG. 12 is a top plan view of another embodiment, in the idle or unopened condition;

FIG. 13 is a vertical medial cross section, partly in side elevation, of the form of closure shown in FIG. 12, but with the pouring opening punched and sealed;

FIG. **14*a* is a partial cross section on the line 14—14 of FIG. 12** in one condition;

FIG. **14*b* is a partial cross section on the line 14—14 of FIG. 12** in another condition;

FIG. 15 is a top plan view of a further modification showing the bail extending over an angle of almost 360°;

FIG. 16 is a medial vertical cross section with some parts in side elevation of still another modification;

FIG. 17 is a cross section taken on the line 17—17 of FIG. 16;

FIG. 18 is a combined cross section and side elevation showing still another embodiment in idle position;

FIG. 19 is a view similar to that of FIG. 18 in partially actuated position;

FIG. 20 is a combined cross section and side elevation of a further embodiment;

FIG. 21 is a cross section taken on the line 21—21 of FIG. 20;

FIG. 22 is a cross sectional detail of a modified form;

FIG. 23 is a detail of a position of FIG. 22 with the membrane separated;

FIG. 24 is a perspective view of a modification of that form of the invention shown in FIGS. 18 and 19;

FIG. 25 is a fragmentary cross section taken on the line 25—25 of FIG. 24;

FIG. **26*a*** is a detail to illustrate the relation between the piercing point and its cavity;

FIG. **26*b* is similar to FIG. 26*a*** except that the piercing point has been shifted toward piercing position;

FIG. **26*c* is similar to FIG. 26*b* to show the piercing point just before being thrust through the membrane; and FIG. 26*d*** shows piercing completed.

DESCRIPTION OF THE PREFERRED EMBODIMENT

Turning to FIGS. 1 and 2 there is shown a onepiece closure embodying the principles of the invention comprising a base 10 of any desired form, usually a hollow cylinder, slightly tapered for esthetic reasons, having an annular skirt 11 which, in the example, has an internal thread 14 to engage a complementary thread on the neck of the receptacle (not shown). The base has a top wall 15 which may be sealed with respect to the neck of the receptacle by a liner or sealing ring, as is common. The closure is desirably molded of a plastics composition, e.g. polyethylene or polypropylene, characterized by good plastic memory, viz. capable of being elastically deformed and then of restoring itself to its as-molded condition.

The top 15 has a recess 21, say cylindrical, having a bottom wall 16 (FIG. 3) and a lateral wall 17. The floor of the recess is of a thickness calculated to resist any pressure which may build up in the receptacle but yet capable of being easily pierced.

A flexible bail 25 is defined as a separate portion of the top 15 separated therefrom by a substantially semicircular slit 26, permitting flexure of the bail from the as-molded position of FIG. 1 to the flexed position indicated by broken lines in FIG. 2. The bail is provided with a punch 27 having a shank **27*b* and terminating at its free end in a point 27*a*. Consequently, when access is to be had to the contents of the receptacle for the first time, the punch 27 is brought over to the broken-line position of FIG. 2 by bending the bail and the punch is thrust inwardly of the closure. In this way the wall 16 is pierced by the point 27*a*. See the enlarged detail of FIG. 3. In order that the piercing operation may not generate tags depending from the margin of the opening, it is within contemplation to arrange that the periphery of the floor 16 be beveled, as shown, to provide a peripheral gutter thin enough to ensure that any vestiges or tags of the plastic composition left by the piercing operation are minimized. It will be obvious that, if left in place, these tags could interfere with fluid flow from the receptacle. Although FIG. 3 shows the thin periphery of the floor 16 as knife-edged, sufficient material will be left to ensure against unintended dislodgement of the circular floor portion 16**.

In order to guide the punch 27 during its movement toward and during piercing, it is desirable to form the shank of the punch as a pilot 29 of a diameter which will have a sliding fit within the lateral wall 17.

From the foregoing it will have become apparent that the consumer will purchase a receptacle and cap which is tamper proof and which may be placed in service by deforming the bail 25 from the position of FIG. 1 to the position of FIG. 2. At the end of this operation the thumb may press upon the bail to force the point 28 through the membrane 16. Following piercing, the bail and punch are withdrawn and the user may discard the punch-out membrane. Thereafter the pilot 29 may serve as a cork closing off the recess 21 and sealing the contents of the receptacle.

While the form of device described in connection with FIGS. 1 and 2 may be easily molded it may, due to its out-of-round character, present some difficulty if applied to the receptacle by an automatic capping machine. Accordingly, there is disclosed an alternative (FIGS. 4 and 5) having a cylindrical configuration for at least a portion 31 of its height to be gripped by the rotary chuck of a capping machine. In this case the bail **25*a*** will lie within the confines of the chuck jaws.

It will be understood that, although the form of invention shown in FIGS. 1 and 2 includes threads 14, these are eliminated in the case of a cap which is engaged with the receptacle through bead-and-groove means, requiring only straight thrust for assembly.

It will be understood that the clearance gap 26 or 32 will be minimal, having in mind the exigencies involved in fabricating the molds and molding the parts. By so doing the bail **25*a* may be actuated between active and inactive positions without hindrance and, in the case of capping by means of a chuck, the bail may be grasped along with the skirt 11, without harmful deformation. As seen in FIG. 5, a notch 34** may be provided to accept the fingernail upon initial lifting of the bail.

FIGS. 6 through 11 relate to another modification wherein the base 41 and its mode of attachment to the receptacle are as described above. In this case the top 42 has a radially directed channel 55 to receive a piercing element 44 extending radially inwardly of the bail 45, this latter being similar to the bail 25 and displaceable in similar manner. The top 42 has a recess 47 meeting the channel 55, said recess having a lateral wall 48 and a bottom wall 49, the two walls meeting to form a sharp corner 51. It is to be noted that the bottom wall of the recess is somewhat thinner than adjacent parts of the closure and serves as a puncturable membrane in the same way as the wall 16 previously described. The piercing element 44 is normally nested within a branch recess 55. Desirably the element 44 is retained in the recess 55 by detent action as shown in FIG. 11. The element 44 is easily dislodged from the recess when the bail 45 is lifted.

To open the closure for the first time the bail 45 is lifted (FIG. 8) and, at the same time, the point 52 is brought against the lateral wall 48 of the recess 40. Continued displacement of the bail will cause the point to shift gradually until it is located in the corner 51. FIG. 8 shows the point in the process of sliding along the wall 48. As the bail is displaced further the element 44 will rotate about its point as a fulcrum until it is vertical or substantially so. Now, as the pressure applied to the butt end of the element 44 (FIG. 9) is increased, the point 52 will be forced through the membrane 49 to form the pouring exit (FIG. 10).

For convenience of exposition the thickness of the pierced membrane has been exaggerated intentionally. In practice, this thickness will be only a few thousandths of an inch. Experimental models have demonstrated that a clean hole, free of tags, is punched out. However, it will be understood that a shoulder (not shown) may be provided just behind the point 52, to shear any tags which may remain following piercing.

Another embodiment is illustrated in FIGS. 12, 13, **14*a* and 14*b*. These figures are intended to disclose one way in which a guided punch may be incorporated in a known type of closure. In these prior disclosures a strap extends from the body of the closure and a piercing element is carried at the distal end of the strap. This strap is secured to the body of the closure in such a way that an automatic capping machine may be availed of without interfering with the strap or punch. The particular improvement disclosed in FIGS. 12, 13, 14*a* and 14*b* comprises a punch 61 having two diameters; one, 61*a*, of some selected diameter, based on the flow rate, and another, 61*b*, greater diameter, meeting the smaller in a shoulder 61*c*. This latter has a working surface designed to sever the tags left as a result of the piercing operation. Stated otherwise, the point 61***d* will penetrate the membrane 63 (FIG. 14*a*) and will be followed by the shoulder 61*c* which shears any tags left by the piercing operation. Thus, a clean pouring hole 67 (FIG. 14*b*) is realized. It will be noted that the portion 61*b* of the punch is guided with a sliding fit in a bore 68 in the closure body whereby to steady the punch 61*a* in its stroke towards and during the membrane-piercing tag-clearing step.

FIG. 15 is a top plan view of an alternative embodiment in which the resiliency of a slender, flexible bail 71 is relied upon to permit easy location of the guiding portion 71*a* of the punch within the bore 71*b*. By means of this construction there is no need to fold the bail over as shown, for example, in FIG. 13 and, moreover, there is no obstruction to a capping machine chuck.

FIGS. 16 and 17 show a closure embodying the principles of the invention in a situation where the pouring opening is desirably located near the outer periphery of the closure rather than at the center.

In this embodiment, the piercing element 81 is as before, and is secured at its basal end to the bail 45*b*. A saddle 82 frictionally receives the element 81 in its initially assembled position, the saddle including resilient elements 84—84 defining a throat 85. Thus, following molding of the part with the element 81 directed axially, the element 81 may be bent over to be detachably held in the saddle 82 pending initial use of the closure. The broken line representation of the element 81 on the left of FIG. 16 shows the as-molded position thereof. It is believed that the construction and operation of this form of the invention will have become evident from the preceding description.

FIGS. 18 and 19 illustrate still another embodiment in which a member 91 is joined by one end to the bail 92 which functions similarly to the several forms of bail hereinbefore referred to. A piercing element 93 is located at the distal end of the member 91 and functions to pierce the membrane 95 in the same way as those piercing members heretofore described. In this form of the invention it is unnecessary to use any special care in directing the piercing element 93 into the bore 96 but simply to lift the bail 92 at its left-hand side, as seen in FIG. 19 and to swing it clockwise using the abutment of the finger 97 against the wall 98 as a fulcrum. The arrangement of the parts is such that rotation of the member 91 directs the element 93 into the bore 96 and toward membrane-piercing position. Compared to previously-described embodiments a single movement of the member 91 replaces the two movements otherwise required, viz., location of the piercing element in its bore and thrusting movement to effect piercing.

A modification of that form of the invention shown in FIGS. 18 and 19 is seen in FIGS. 24 and 25. In this case, the piercing point 140 is part of a member 141 molded integrally with the substantially semi-circular bail 143 similarly to the parts 91 and 92 (FIG. 18). When the bail 143 is lifted the piercing point 140 functions in the same way as the member 93. However to assure that the member 93 will have adequate rigidity and to avoid the tendency to buckle, the member 141 is provided with two additional elements 126–146 flanking the point 140. These elements 126–146 are each associated with a well 130 similar to the well 96 (FIG. 18). Thus, when the member 141 is pivoted to active position the two flanking elements 146—146 move therewith, the relationship of the parts being such that the stiffness of the point 140 is supplemented and piercing of the membrane 150 made more reliable. However, if a venting type of cap is desired, and gas under pressure in the receptacle is to be vented prior to full opening of the pouring hole the floor of the wells 130—130 may be made sufficiently thin, and the points 126—126 sufficiently sharp to enable the additional venting holes to be realized.

FIGS. 26*a* and 26*d* are details to show several positions of the point 140 in relation to a well 130. In view of the preceding description these several figures are not believed to require elaboration.

In order to provide a low profile it may be advantageous to arrange the bail in such a way that no part thereof will protrude outwardly beyond the top of the closure. Thus, turning to FIGS. 20 and 21 the bail 99 may lie in a plane which is inclined at an acute angle with respect to the horizontal plane. By so doing the fixed part 101 of the bail may be at the top and the displaceable part 102 near the bottom. In this case the piercing member 103 will lie adjacent the lateral wall or skirt 104 of the closure. In order to hold the bail and piercing member in the idle position just described, a seat 110 may be provided, this latter having a pair of resilient wings to grasp the member 103 but allow easy disengagement thereof. The foregoing feature amounts to a detent between member 103 and the bifurcated seat 110.

Another modification is depicted in FIG. 22. The principal feature shown by this embodiment is means by which the membrane is separated from the body of the closure and then discarded, as compared to those forms hereinbefore described wherein vestiges of the punched membrane may or may not be completely severed. To this end the pouring opening 120 is molded with a membrane 121 obturating the same. The periphery of the membrane may be feathered to facilitate severance. Protruding outwardly from the membrane is a post 124 provided with one or more corrugations, each of which is a conical frustum, with the larger diameter toward the membrane. The distal end of the strap or bail 126 has a boss 127 provided with a straight, blind hole 128. The diameter of the latter relative to the maximum diameter of the post 124 is such that a tight, "corking" effect may be realized. The parts are molded so that the bail 126 is folded back free from the position shown. Upon initial use the boss 127 is forced over the post 124 to realize a jam fit. The bail may then be given reverse movement to break the membrane loose from the opening 120 and thus enable pouring therethrough. It will be apparent that the reverse slope or rake 128 of the teeth of the post 124 will augment the grip of the boss 127 on the post.

Following the foregoing manipulation the receptacle is closed by forcing the boss 127 into the opening 120. To this end the fit therebetween can be made as snug as desired depending upon the nature of the fluid contents of the receptacle. In any event there is not danger of losing the stopper represented by the boss 127. If desired, the broken out membrane 121 and the post 124 may be separated and the latter discarded.

In order that piercing of the membrane may be accomplished with the least effort, it is preferred that the piercing point have an apex angle of less than 90°.

I claim:

1. A one-piece dispensing closure having body means for securement to means defining a pouring opening through which the contents of a receptacle may be dispensed, said opening adapted to be opened and closed by means of said closure to permit flow and to terminate flow respectively, said body means including a circular top, said closure comprising resilient but generally shape retaining plastics composition, a cylindrical recess in said top, said recess having a floor constituted as a thin puncturable membrane, a flexible bail of substantially semi-circular configuration integrally formed with the body means and connected by its ends thereto, and positioned within the extent of the top, to provide a continuous circular outline for the top, the bail carrying a sharp puncturing member capable of penetrating said membrane upon application of digital force to the member intermediate its ends whereby the bail may be flexed about its ends to position the point of the sharp member confronting the membrane whereupon the member may be thrust through the membrane to present a pouring opening therethrough when the member is withdrawn.

2. The closure in accordance with claim 1 wherein said member is a cone having an apex angle less than 90°.

3. The closure in accordance with claim 1 in which said member has an annular shoulder to shear tags left around the periphery of the punched opening.

4. A one-piece dispensing closure comprising means to attach the same to a receptacle for fluent material, said closure comprising an inverted cup-shaped body comprising a skirt and a top wall, a flexible bail of substantially U-shaped configuration, the free ends of the legs thereof merging with the body, means defining a recess in said top, said recess having a floor comprising a puncturable membrane, a puncturing member adapted to puncture the membrane when force is applied inwardly of the receptacle, said member comprising a shank joined to the bight of the bail and a piercing end including a point at its free end extending from the shank and coaxially therewith, said piercing end being of smaller diameter than the shank to define an annular shoulder therewith, said shoulder being coactive with the margin of the membrane to shear tags remaining following puncturing, the puncturing member serving to close the opening formed in the membrane following puncturing.

5. The combination in accordance with claim 4 wherein said shoulder lies in a plane at right angles to the axis of the puncturing member to provide a cutting face to shear any tags extending from the punctured membrane following puncturing.

* * * * *

UNITED STATES PATENT OFFICE

CERTIFICATE OF CORRECTION

Patent No. 4,077,537 Dated March 7, 1978

Inventor(s) Sidney M. Libit

It is certified that error appears in the above-identified patent and that said Letters Patent are hereby corrected as shown below:

Column 3, Line 22, after "pierced" insert simply by finger pressure applied to that portion of the aforementioned bail associated with a punch 27 to be described.

Signed and Sealed this

*Twenty-ninth* Day of *August 1978*

[SEAL]

*Attest:*

RUTH C. MASON
*Attesting Officer*

DONALD W. BANNER
*Commissioner of Patents and Trademarks*